US011572902B2

(12) United States Patent
Nytko et al.

(10) Patent No.: US 11,572,902 B2
(45) Date of Patent: Feb. 7, 2023

(54) MANIFOLD FOR REDUCING OR GENERATING PILOT PRESSURE FOR A PILOT OPERATED EXCAVATOR

(71) Applicant: Deere & Company, Moline, IL (US)

(72) Inventors: Alexander J. Nytko, Dubuque, IA (US); Jeff Dobchuk, Saskatoon (CA); Kevin W. Campbell, Dubuque, IA (US); Kristen D. Cadman, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 17/368,225

(22) Filed: Jul. 6, 2021

(65) Prior Publication Data

US 2023/0010121 A1 Jan. 12, 2023

(51) Int. Cl.
*F15B 15/20* (2006.01)
*F15B 1/26* (2006.01)

(52) U.S. Cl.
CPC ..... *F15B 15/202* (2013.01); *F15B 1/26* (2013.01)

(58) Field of Classification Search
CPC .. F15B 2211/36; F15B 2211/35; F15B 13/043
See application file for complete search history.

(56) References Cited

U.S. PATENT DOCUMENTS

| | | | |
|---|---|---|---|
| 4,753,158 | A | 6/1988 | Hirata et al. |
| 8,527,158 | B2 | 9/2013 | Faivre et al. |
| 9,169,620 | B2 | 10/2015 | Gabibulayev |
| 9,435,105 | B2 | 9/2016 | Fleischmann et al. |
| 2021/0095437 | A1 | 4/2021 | Brabec |

FOREIGN PATENT DOCUMENTS

WO WO-2014137250 A1 * 9/2014 ..... B62D 5/091

* cited by examiner

*Primary Examiner* — Thomas E Lazo
*Assistant Examiner* — Daniel S Collins
(74) *Attorney, Agent, or Firm* — Lucian Wayne Beavers; Patterson Intellectual Property Law, PC

(57) ABSTRACT

A pilot hydraulic system may include a pilot pressure source, a pilot pressure return tank, a pilot valve, a pilot pressure supply line connecting the pilot pressure source to the pilot valve, and a pilot pressure return line connecting the pilot pressure return tank to the pilot valve. A main control valve may include a pilot chamber. A pilot pressure control line connects the pilot valve to the pilot chamber. A hydraulic sub-system is provided for modifying pilot pressure provided to the pilot chamber of the main control valve. The hydraulic sub-system may include a variable orifice valve disposed in the pilot pressure control line, a pilot pressure bypass line communicating the pilot pressure control line downstream of the variable orifice valve with the pilot pressure return line, and an electrohydraulic pressure reducing valve (EHPRV) disposed in the pilot pressure bypass line.

15 Claims, 11 Drawing Sheets

MANIFOLD FOR REDUCING OR GENERATING PILOT PRESSURE FOR A PILOT OPERATED EXCAVATOR

FIELD OF THE DISCLOSURE

The present disclosure relates to pilot operated controls for a work machine.

BACKGROUND

When implementing automated functions in a pilot operated work machine such as an excavator there is a need for a system for generating or reducing hydraulic pilot pressure in response to commands from an automatic controller.

SUMMARY OF THE DISCLOSURE

In an embodiment a pilot hydraulic system may include a pilot pressure source, a pilot pressure return tank, a pilot valve, a pilot pressure supply line connecting the pilot pressure source to the pilot valve, and a pilot pressure return line connecting the pilot pressure return tank to the pilot valve. A main control valve may include a pilot chamber. A pilot pressure control line connects the pilot valve to the pilot chamber. A hydraulic sub-system is provided for modifying pilot pressure provided to the pilot chamber of the main control valve. The hydraulic sub-system may include a variable orifice valve disposed in the pilot pressure control line, a pilot pressure bypass line communicating the pilot pressure control line downstream of the variable orifice valve with the pilot pressure return line, and an electrohydraulic pressure reducing valve (EHPRV) disposed in the pilot pressure bypass line.

Numerous objects, features and advantages of the present invention will be readily apparent to those skilled in the art upon a review of following description in conjunction with the accompanying drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
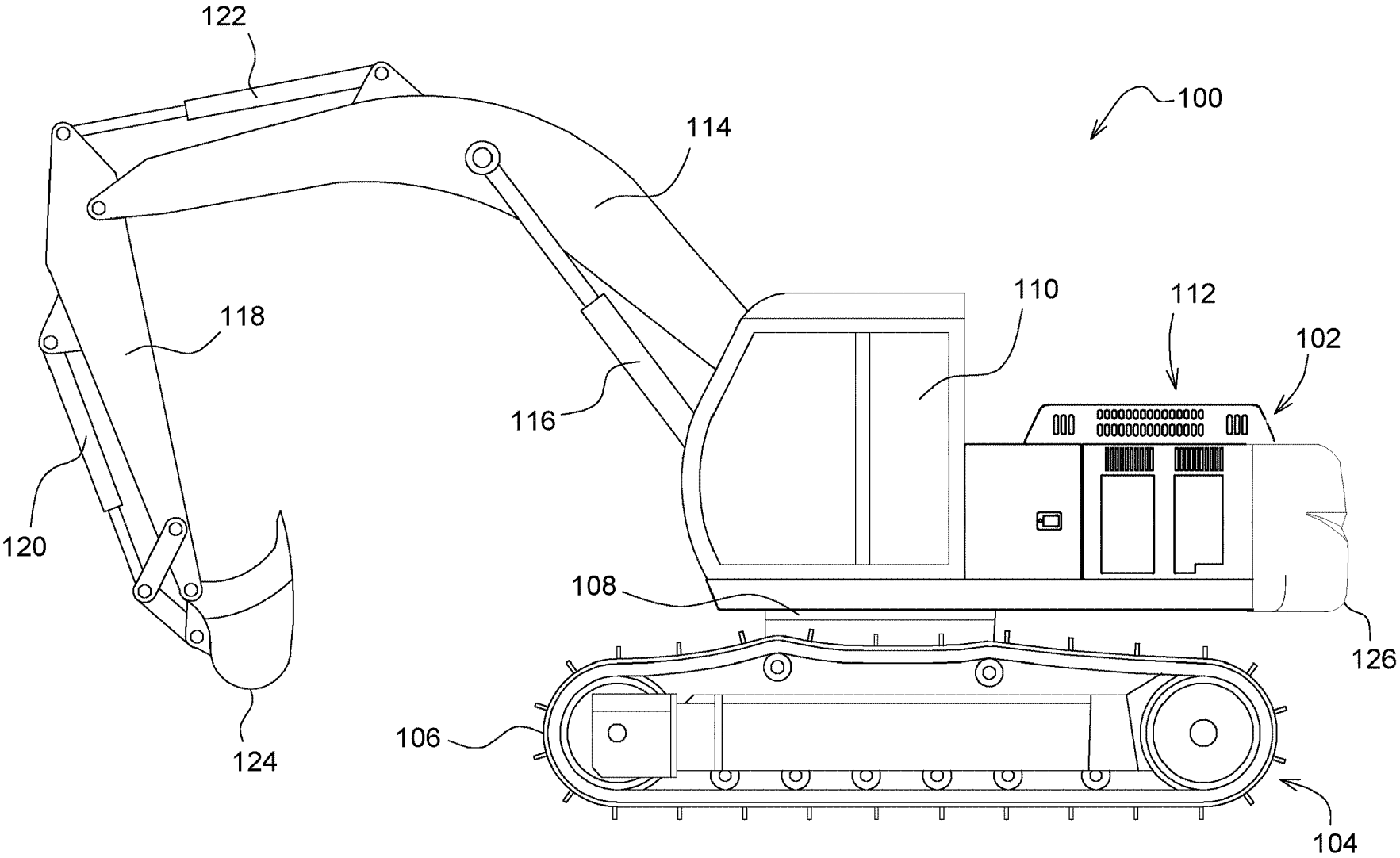
FIG. 1 is a left side view of a work machine, for example an excavator, including the pilot hydraulic system of the present disclosure.

An example embodiment of a work machine is shown in FIG. 1. The machine is embodied as an excavator 100. The present disclosure is not limited, however, to an excavator and may extend to other work machines such as a loader, crawler, harvester, skidder, backhoe, feller buncher, motor grader, or any other work machine. As such, while the figures and forthcoming description may relate to an excavator, it is to be understood that the scope of the present disclosure extends beyond an excavator and, where applicable, the term "machine" or "work machine" will be used instead. The term "machine" or "work machine" is intended to be broader and encompass other vehicles besides an excavator for purposes of this disclosure.

Referring to FIG. 1, the machine 100 includes a chassis comprising an upper frame 102 pivotally mounted to an undercarriage 104. The upper frame 102 can be pivotally mounted on the undercarriage 104 by means of a swing pivot 108. The upper frame 102 is rotatable about 360 degrees relative to the undercarriage 104 on the swing pivot 108. A hydraulic motor (not shown) can drive a gear train (not shown) for pivoting the upper frame 102 about the swing pivot 108.

The undercarriage 104 can include a pair of ground-engaging mechanisms such as tracks 106 on opposite sides of the undercarriage 104 for moving along the ground. Alternatively, the machine 100 can include more than two tracks or wheels for engaging the ground. The upper frame 102 includes a cab 110 in which the machine operator controls the machine. As shown schematically in FIG. 2, the cab 110 can include an operator's seat 128 and a control station 130. The control station 130 may include left and right joystick controls 228L and 228R, as well as other controls. The human operator can actuate one or more of the controls of the control station 130 for purposes of operating the work machine 100.

The machine 100 also includes a boom 114 that extends from the upper frame 102 adjacent to the cab 110. The boom 114 is rotatable about a vertical arc by actuation of a pair of boom cylinders 116. A dipper stick or arm 118 is rotatably mounted at one end of the boom 114 and its position is controlled by a hydraulic arm cylinder 122. At the end opposite the boom 114, the dipper stick or arm 118 is rotatably coupled to a work implement or bucket 124 that is pivotable relative to the arm 118 by means of a hydraulic implement pivoting cylinder 120.

The upper frame 102 of the machine 100 includes an outer shell cover over an engine assembly 112. At an end opposite the cab 110, the upper frame 102 includes a counterweight body 126. The counterweight body 126 comprises a housing filled with material to add weight to the machine and offset a load collected in the bucket 124. The offset weight can improve the craning or digging performance characteristics of the machine 100.

Figure 2:
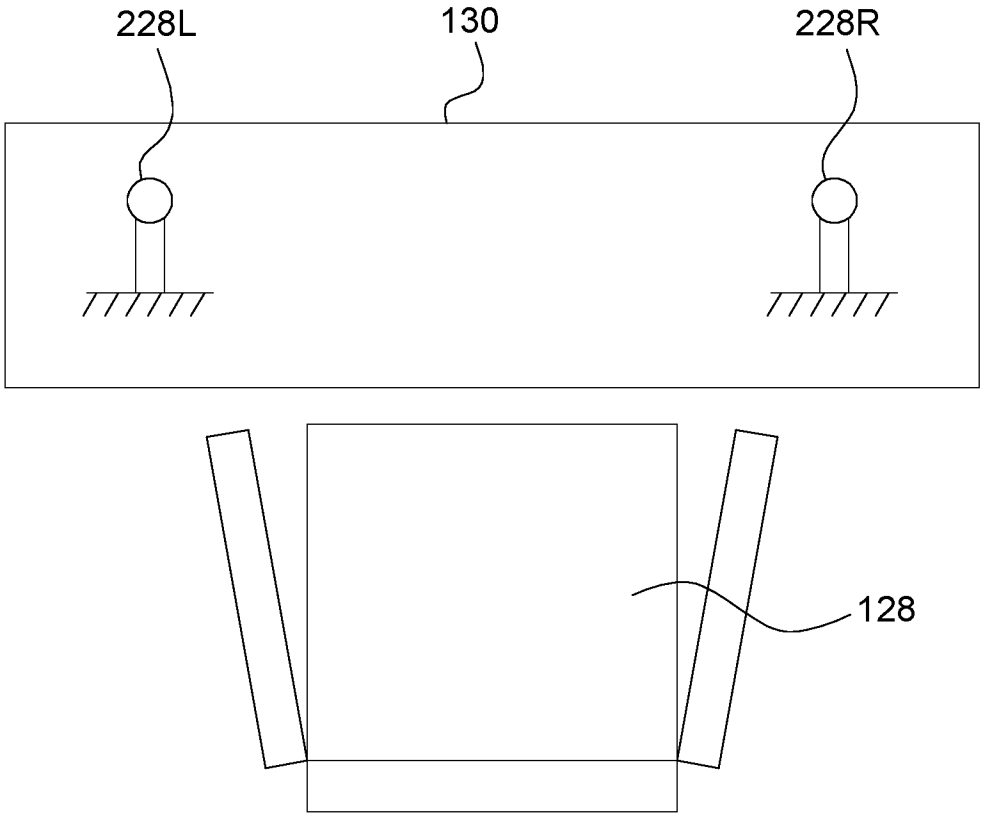
FIG. 2 is a schematic illustration of an operator's seat and control station including left and right joystick controls.

The operator of the machine 100 may manually control the boom cylinders 116, the hydraulic arm cylinders 122, the hydraulic implement pivoting cylinders 120 and the hydraulic motor that pivots the upper frame 102 about the undercarriage 104 on the swing pivot 108. As schematically shown in FIG. 2 these controls may include a left hand joystick 228L and a right hand joystick 228R on opposite sides of the operator's seat 128. The two joysticks typically are configured to control bi-directional movement of the various hydraulic actuators according to either an ISO control pattern or an SAE control pattern. For example, in an ISO control pattern the two joysticks are configured as follows:

Left hand left=Swing left
Left hand right=Swing right
Left hand forward=Stick Boom (Dipper) away
Left hand back=Stick Boom (Dipper) close
Right hand left=Bucket curl in (closed)
Right hand right=Bucket curl out (dump)
Right hand forward=Main Boom down
Right hand back=Main Boom up.

In a manually controlled work machine the left hand and right hand joysticks directly control spool valves which direct operating hydraulic pressure to the various actuators. In a pilot controlled work machine the left hand and right hand joysticks control pilot valves which direct pilot pressure to main operating valves which in turn direct operating hydraulic pressure to the various actuators.

The present disclosure is directed to an improvement in pilot controlled work machines which provides for interaction of an automated control system to supplement the pilot pressure control otherwise directed by the human operator. One example of such automated control systems is an automated grade control system whereby the work machine is configured to automatically control the grade, i.e. elevation, and/or the position of the work implement.

Another example of such automated control system has a virtual "fence mode" wherein the control system is configured to prevent the work tool from moving past a virtual fence established within the control system.

The following description of the pilot hydraulic system of the present invention is set in the context of an automated grade control system for an excavator. It will be understood that the pilot hydraulic system is applicable to other work machines and to other automatic control systems.

Figure 3:
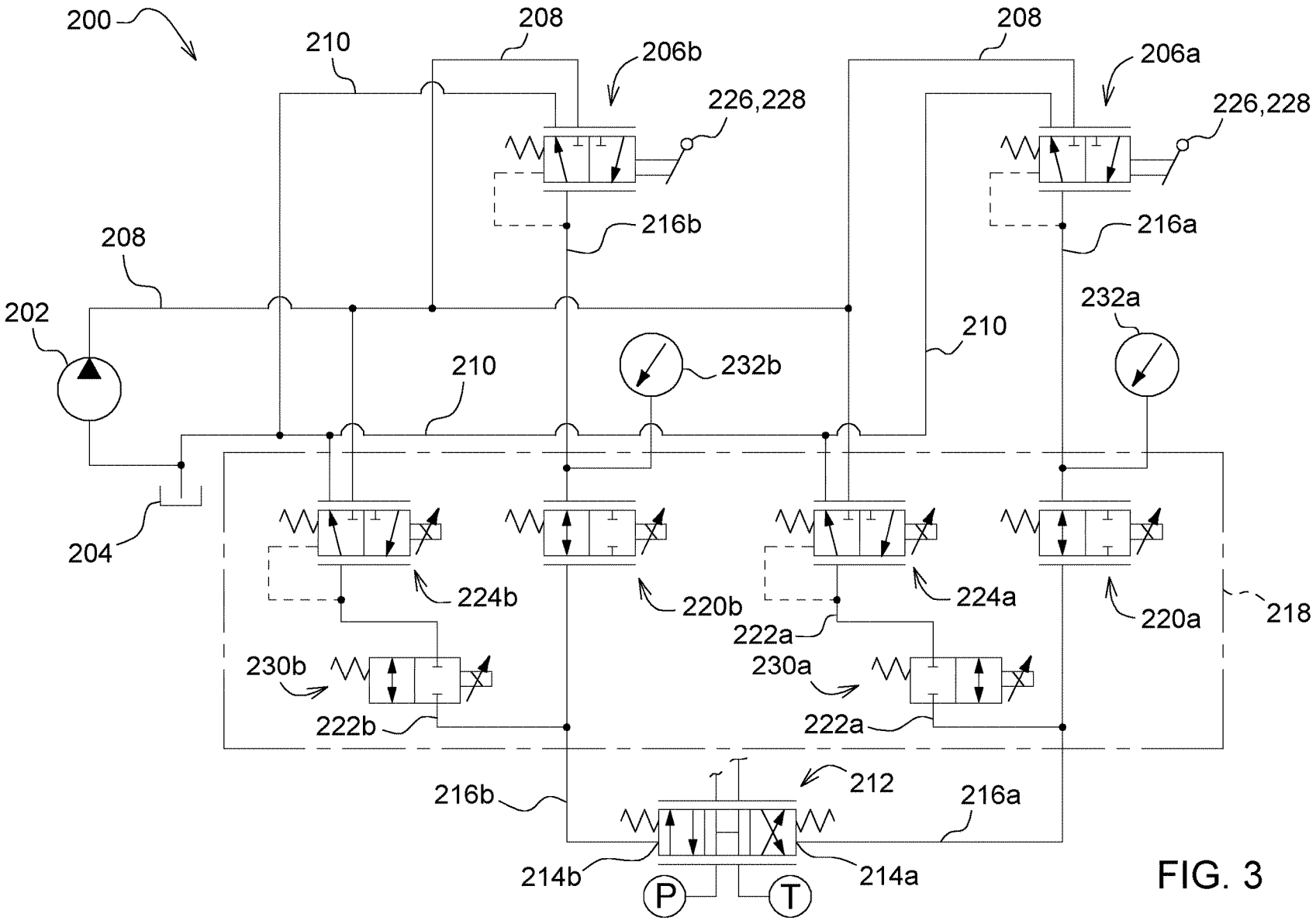
FIG. 3 is a schematic illustration of a first embodiment of a pilot hydraulic system of the present disclosure.

FIG. 3 is a schematic illustration of the pilot hydraulic system 200 of one embodiment of the present disclosure. The pilot hydraulic system 200 includes a pilot pressure source 202, a pilot pressure return tank 204, a first pilot valve 206*a*, a second pilot valve 206*b*, a pilot pressure supply line 208 connecting the pilot pressure source 202 to the first and second pilot valves, and a pilot pressure return line 210 connecting the pilot pressure return tank 204 to the first and second pilot valves.

The pilot hydraulic system 200 further includes main control valve 212 including first and second pilot chambers 214*a* and 214*b*. A first pilot pressure control line 216*a* connects the first pilot valve 206*a* to the first pilot chamber 214*a*. A second pilot pressure control line 216*b* connects the second pilot valve 206*b* to the second pilot chamber 214*b*. The main control valve 212 will control flow of operating hydraulic fluid from an operating hydraulic fluid source P to any one of the hydraulic actuators such as previously described, and return of hydraulic fluid from the actuator to an operating hydraulic fluid tank T. It will be understood that there will be such a pilot hydraulic system 200 associated with each of the hydraulic actuators to be controlled, such as the boom cylinders 116, the hydraulic arm cylinders 122, the hydraulic implement pivoting cylinders 120 and the hydraulic motor that pivots the upper frame 102 about the undercarriage 104 on the swing pivot 108.

A manually operable pilot valve control input 226 includes an input handle 228 and at least the first and second pilot valves 206*a* and 206*b*. The handle 228, which may be a joystick 228, is configured to move the first pilot valve 206*a* when the handle 228 is moved in a first direction and to move the second pilot valve 206*b* when the handle 228 is moved in a second direction. For example, the handle 228 may represent the left hand joystick 228L shown in FIG. 2 and the first and second directions may be the forward and back directions of the left hand joystick so as to control the hydraulic arm cylinders 122 to move the arm 118 away from and closer to the boom 114 when using an ISO control pattern for an excavator.

The pilot hydraulic system 200 further includes a hydraulic sub-system 218 generally containing those features contained within the dashed rectangle indicated as 218 in FIG. 3. Hydraulic sub-system 218 may also be referred to as a manifold 218. The hydraulic sub-system 218 will allow an automated control system such as further described below with reference to FIG. 4 to modify pilot pressure that would otherwise be provided from the pilot valves 206*a* and 206*b* to the pilot chambers 214*a* and 214*b* of the main control valve 212.

The hydraulic sub-system 218 includes a first variable orifice valve 220*a* disposed in the first pilot pressure control line 216*a* and a second variable orifice valve 220*b* disposed in the second pilot pressure control line 216*b*.

The hydraulic sub-system 218 further includes a first pilot pressure bypass line 222*a* communicating the first pilot pressure control line 216*a* downstream of the first variable orifice valve 220*a* with the pilot pressure return line 210, and a second pilot pressure bypass line 222*b* communicating the second pilot pressure control line 216*b* downstream of the second variable orifice valve 220*b* with the pilot pressure return line 210. The variable orifice valves 220*a* and 220*b* may be bidirectional proportional variable orifice valves.

The hydraulic sub-system 218 further includes a first electrohydraulic pressure reducing valve (EHPRV) 224*a* disposed in the first pilot pressure bypass line 222*a* and a second EHPRV 224*b* disposed in the second pilot pressure bypass line 222*b*.

The hydraulic sub-system 218 may further include a first on/off valve 230*a* disposed in the first pilot pressure bypass line 222*a* between the first EHPRV 224*a* and the first pilot pressure control line 216*a*, and a second on/off valve 230*b* disposed in the second pilot pressure bypass line 222*b* between the second EHPRV 224*b* and the second pilot pressure control line 216*b*. For example, the first and second on/off valves 230*a* and 230*b* may be variable orifice/flow control valves such as a Model PWK10020V or a Model PWK06020V available from HYDAC Company.

The hydraulic sub-system 218 may further include a first pressure sensor 232*a* communicated with the first pilot pressure control line 216*a* between the first pilot valve 206*a* and the first variable orifice valve 220*a*, and a second pressure sensor 232*b* communicated with the second pilot pressure control line 216*b* between the second pilot valve 206*b* and the second variable orifice valve 220*b*.

Figure 4:
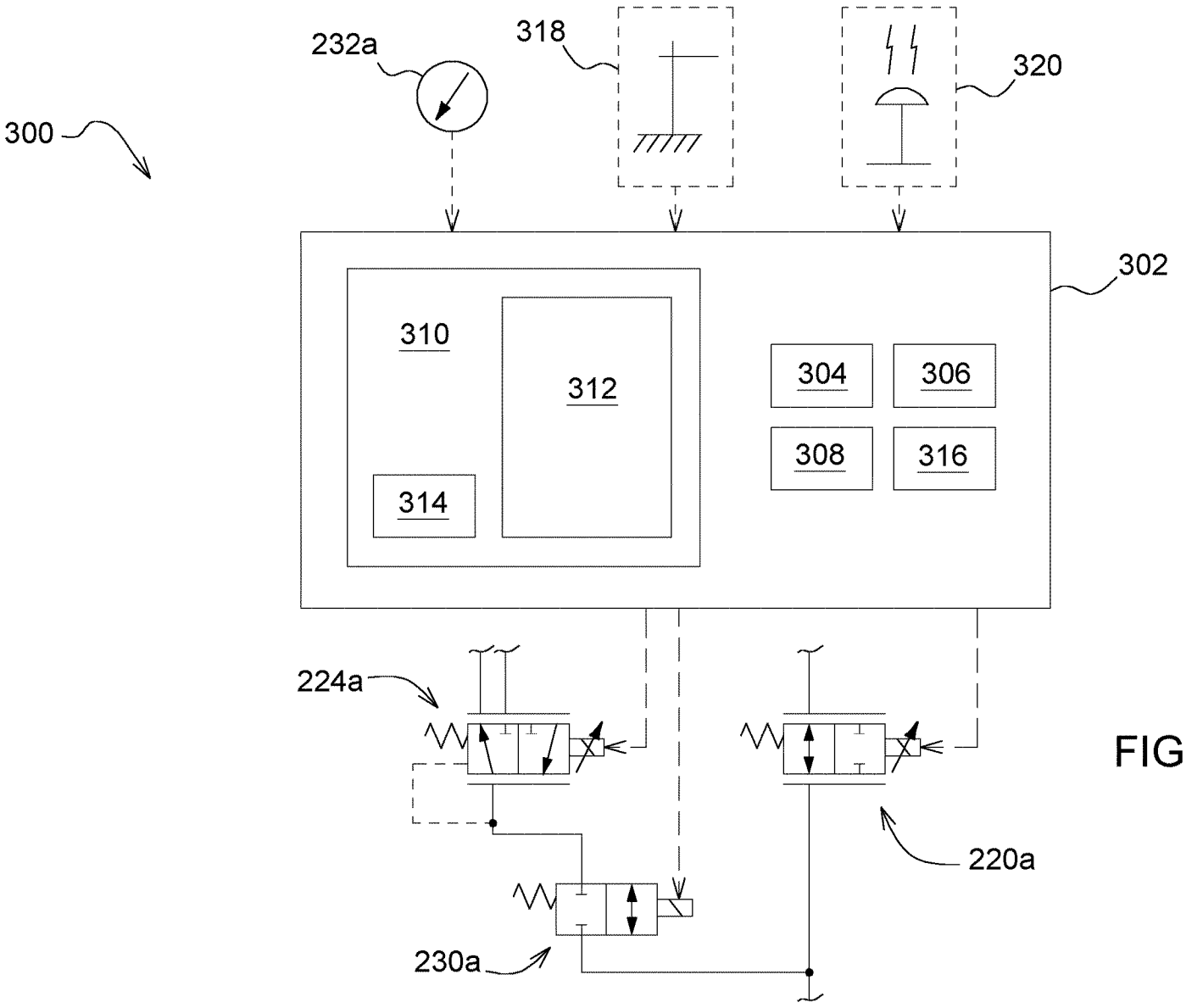
FIG. 4 is a schematic illustration of a control system for the work machine.

Control System of FIG. 4

As schematically illustrated in FIG. 4, the working machine 100 includes a control system 300 including a controller 302. The controller 302 may be part of the machine control system of the work machine 100, or it may be a separate control module. The controller 302 may be mounted in the operators cab 110. The controller 302 is configured to receive input signals from various sensors. The signals transmitted from the various sensors to the controller 302 are schematically indicated in FIG. 4 by dashed lines connecting the sensors to the controller with an arrowhead indicating the flow of the signal from the sensor to the controller 302.

For example, pressure signals from the pressure sensors such as 232*a* will be received so that the controller can monitor the hydraulic pressure from each of the pilot control valves such as 206*a*.

If a grade control system is being implemented on the work machine 100, input signals may be received from a grade control sensor schematically shown as 318. The grade control sensor could utilize a wire line sensor. The grade control sensor could be a laser based system. The grade control system could be based upon signals from a global navigation satellite system.

If a virtual fence mode is being implemented on the work machine 100, input signals may be received from a position sensor schematically shown as 320. The control system 300 may use IMU's, rotary sensors and GPS as position sensors 320 to monitor position of the work machine 100 and its various components.

Similarly, the controller 302 will generate control signals for controlling the operation of the various electro/mechanical valves discussed above, which control signals are indicated schematically in FIG. 4 by dashed lines connecting the controller 302 to the various valves with the arrow indicating the flow of the command signal from the controller 302 to the respective valves. For example, the valves 220*a*, 224*a* and 230*a* are schematically shown in FIG. 4.

Controller 302 includes or may be associated with a processor 304, a computer readable medium 306, a data base 308 and an input/output module or control panel 310 having a display 312. An input/output device 314, such as a keyboard, joystick or other user interface, is provided so that the human operator may input instructions to the controller. It is understood that the controller 302 described herein may be a single controller having all of the described functionality, or it may include multiple controllers wherein the described functionality is distributed among the multiple controllers.

Various operations, steps or algorithms as described in connection with the controller 302 can be embodied directly in hardware, in a computer program product 316 such as a software module executed by the processor 304, or in a combination of the two. The computer program product 316 can reside in RAM memory, flash memory, ROM memory, EPROM memory, EEPROM memory, registers, hard disk, a removable disk, or any other form of computer-readable medium 306 known in the art. An exemplary computer-readable medium 306 can be coupled to the processor 304 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

Particularly the controller 302 may be programmed to have a pilot pressure generation mode and a pilot pressure reduction mode. The pilot pressure generation mode is used to automatically generate a hydraulic pilot pressure signal to the main control valve 212 when the controller determines that the human operator is not sending the necessary hydraulic pilot pressure signal. The pilot pressure reduction mode is used to automatically reduce the hydraulic pilot pressure signal when the controller determines that the main control valve should not be actuated as instructed by the human operator. The controller 302 may also have a normal operation mode, as further described below with reference to FIG. 5, in which pilot pressure from the pilot valve is passed through the hydraulic sub-system to the pilot chamber unmodified.

In the context of an automatic grade control system for an excavator 100 such as shown in FIG. 1 the human operator will typically only command the function of the arm 118 while the boom 114 and bucket 124 are controlled by the controller 302 to keep the bucket tip on the desired grade line. The controller 302 can, if necessary, command a pilot pressure reduction in the pilot pressure line 216*a* going to the main control valve 212 associated with the arm hydraulic cylinders 122. For example, a maximum allowable speed of the arm 118 may be set in the control system 300, and the control system 300 may, if necessary, reduce the arm speed otherwise directed by the human operator's input to joystick 228 to slow down the arm 118. The controller 302 can also send pilot pressure signals to the main control valves 212 associated with the boom cylinders 116 and bucket pivoting cylinders 120 as necessary to control those operations.

In the context of a virtual fence system, if the controller 302 determines that the human operator is swinging the boom 114 into forbidden territory the controller 302 may for example reduce the hydraulic pilot pressure being sent to the main control valve 212 for the hydraulic motor which rotates the boom.

Normal Pilot Valve Operation Mode

Figure 5:
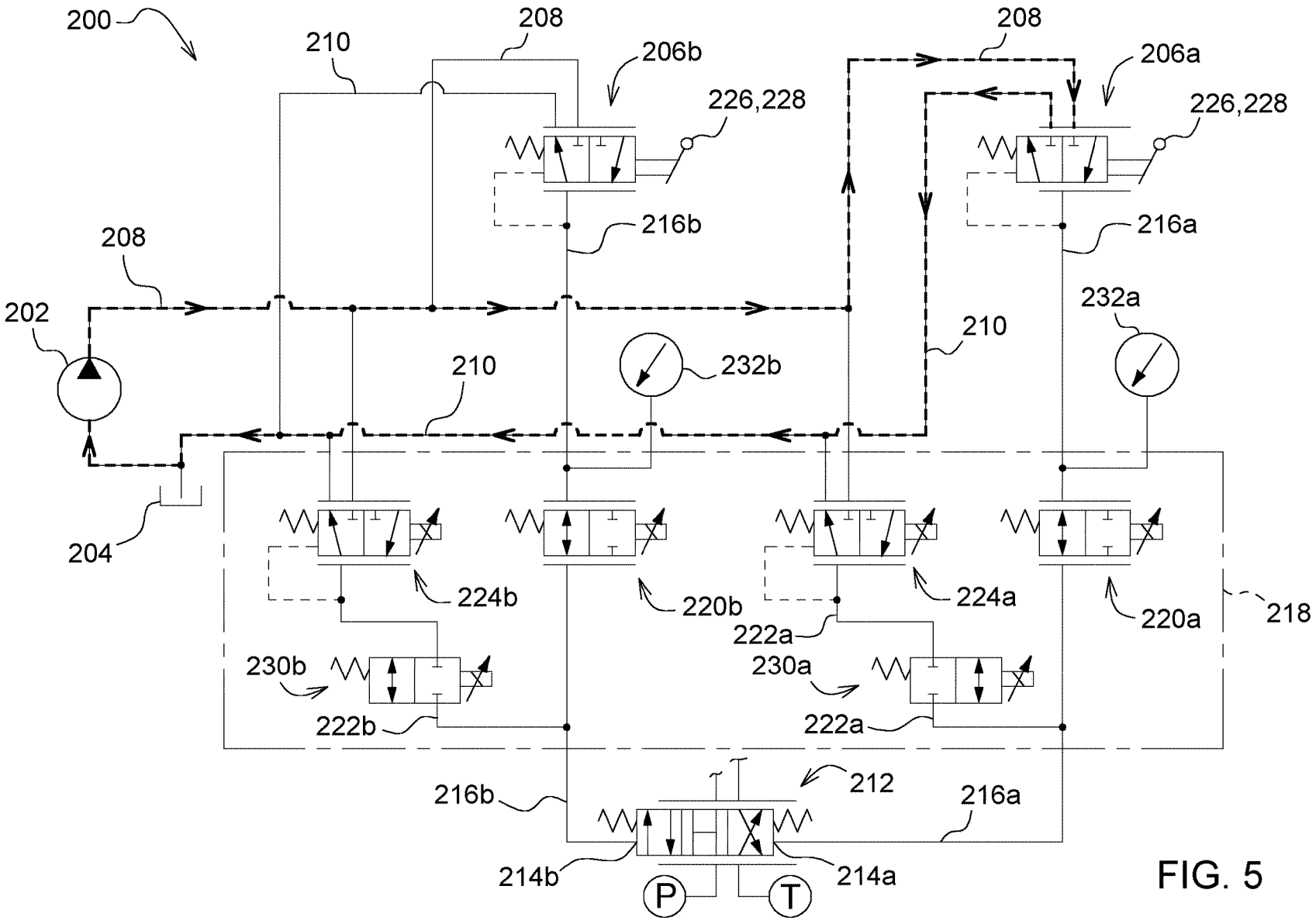
FIG. 5 is a schematic illustration of the pilot hydraulic system of FIG. 3 during normal operation.

FIG. 5 schematically illustrates the normal operation mode of the pilot joystick 228 to direct hydraulic pilot pressure from the first pilot valve 206*a* to the first pilot chamber 214*a* of the main control valve 212. For example, if the human operator moves the joystick 228 in one direction so as to direct hydraulic fluid through the first pilot valve 206*a* the pilot pressure from the first pilot valve 206*a* is passed through the hydraulic sub-system 218 substantially unmodified. The pilot pressure from pilot pressure supply line 208 passes through first pilot valve 206*a* and then through first variable orifice valve 220*a* to the first pilot chamber 214*a*. Note that the second pilot chamber 214*b* is communicated through the second variable orifice valve 220*b* and the second pilot valve 206*b* to the pilot pressure return line 210 so that a pressure differential is created between pilot chambers 214*a* and 214*b* to shift the spool of the main control valve 212 against a biasing spring. The amount of the pressure differential controls the rate at which hydraulic operating fluid is directed through the main control valve 212 to the hydraulic actuator being activated (e.g. the arm cylinders 122).

Pilot Pressure Reduction Mode

Figure 6:
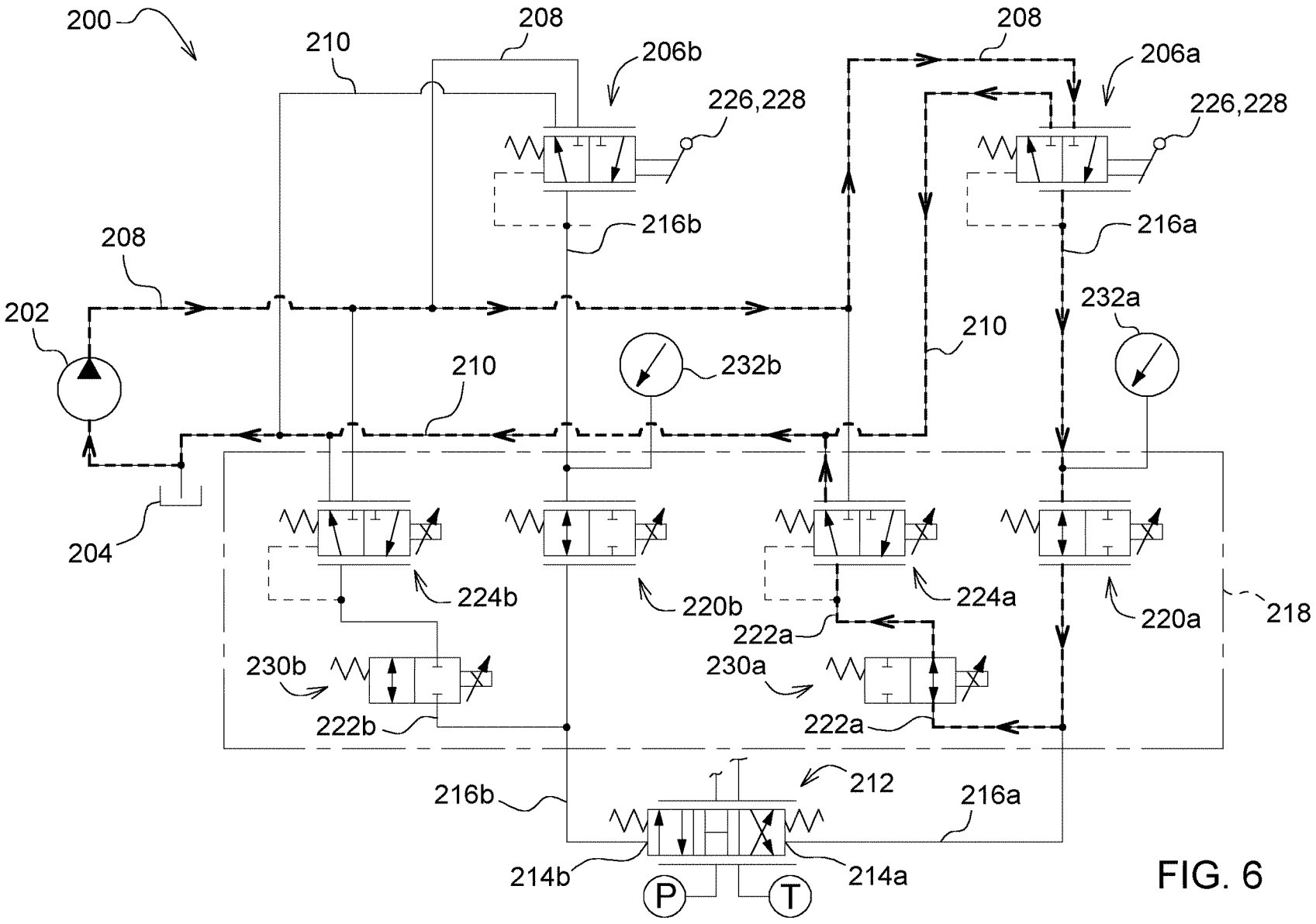
FIG. 6 is a schematic illustration of the pilot hydraulic system of FIG. 3 during operation in a pilot pressure reduction mode.

FIG. 6 schematically illustrates the pilot pressure reduction mode. The human operator is directing the first pilot valve 206*a* to direct pilot pressure to the first pilot chamber 214*a*, but the controller 302 has determined that the pilot pressure should be reduced. The first on/off valve 230*a* is commanded to the "on" state allowing pilot oil from the first pilot pressure control line 216*a* to drain through the first EHPRV 224*a* to the pilot pressure return line 210. The first EHPRV 224*a* is commanded to regulate the pilot pressure delivered to the first pilot chamber 214*a*.

The controller may send a command to the first variable orifice valve 220*a* to create an orifice restricting flow through the first variable orifice valve 220*a* such that the first EHPRV 224*a* can control the pilot pressure without becoming saturated. Saturation is a condition which can occur when the EHPRV cannot reduce pressure down to the commanded value because the pressure source can generate enough flow to maintain the pressure in the source line. In other words in the present case the manually operable pilot valve control input 226 may generate more flow than the EHPRV 224*a* can drain, unless a restriction is created between the manually operable pilot valve control input 226 and the EHPRV 224*a*.

Throughout the pressure reduction operation the controller 302 monitors the pilot pressure via the first pressure sensor 232*a*.

Note that the valve spool of the main control valve 212 is schematically indicated as having moved back toward the right due to the reduced pilot pressure, thus reducing the flow rate of operating hydraulic fluid through the main control valve to the associated hydraulic actuator.

Pilot Pressure Generation Mode

Figure 7:
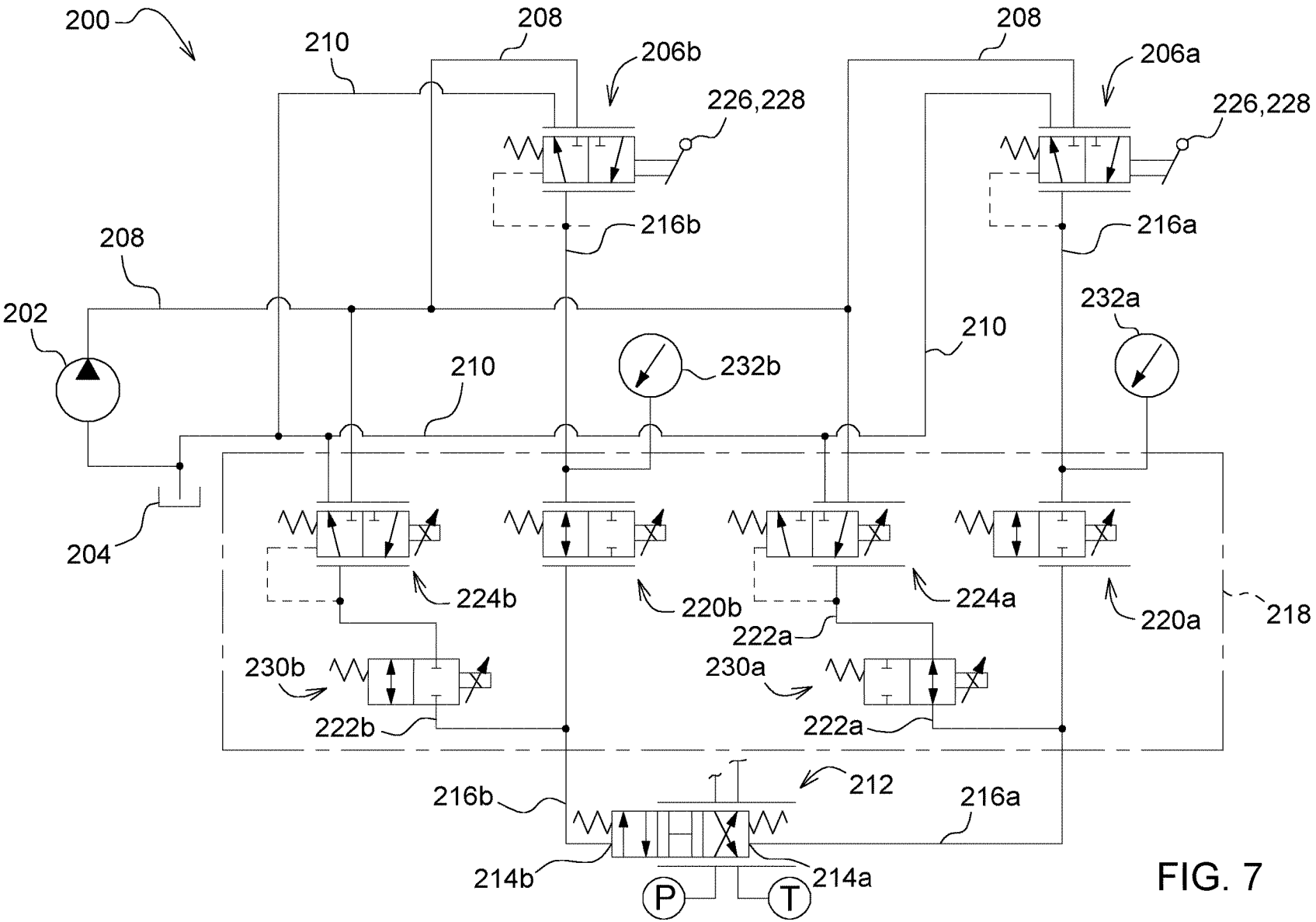
FIG. 7 is a schematic illustration of the pilot hydraulic system of FIG. 3 during operation in a pilot pressure generation mode.
Figure 8:
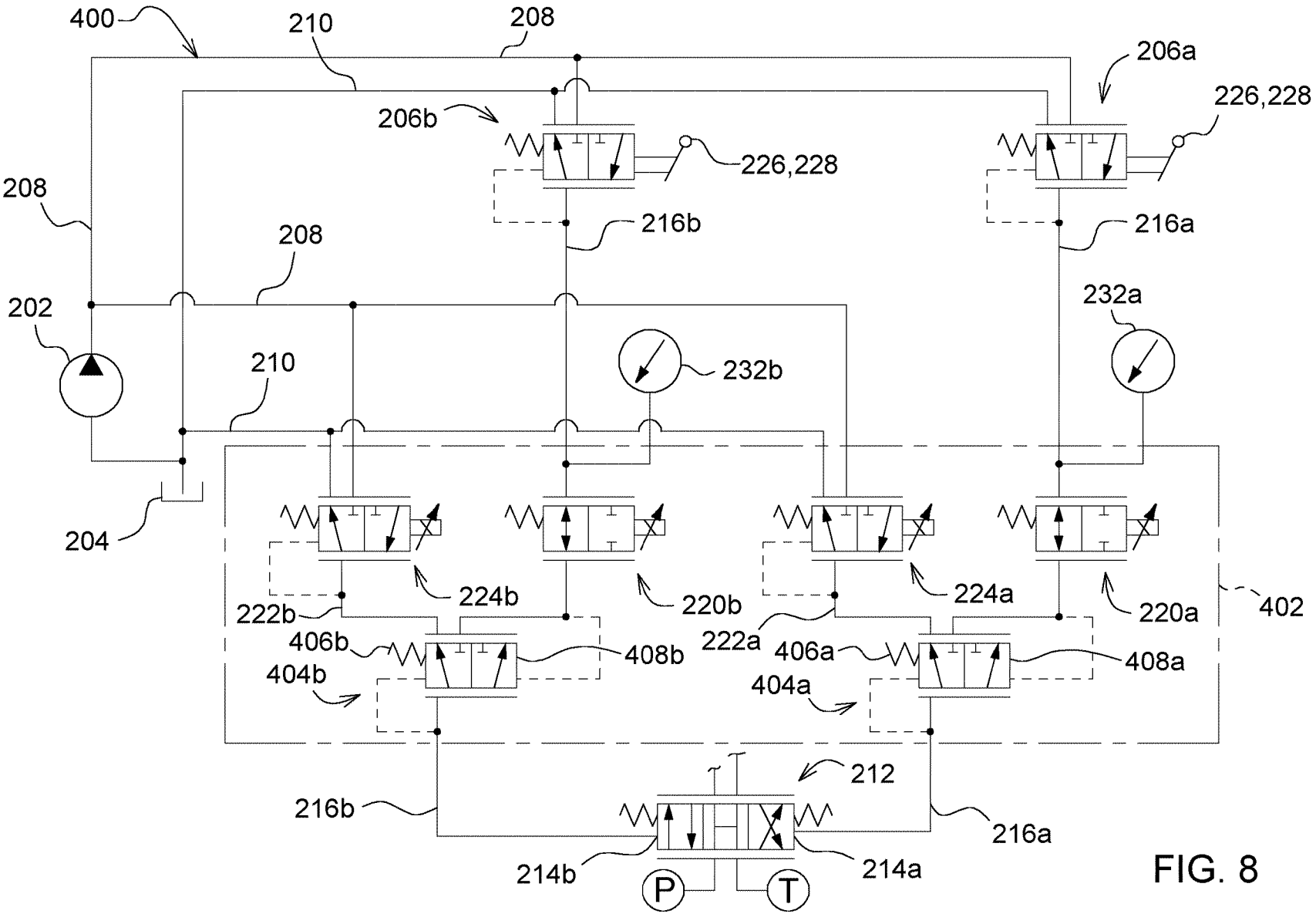
FIG. 8 is a schematic illustration of an alternative embodiment of the pilot hydraulic system.

FIG. 7 schematically illustrates the pilot pressure generation mode. The joystick 228 and the first pilot valve 206*a* are schematically indicated such that the human operator is not directing pilot pressure to the first pilot chamber 214*a*. This mode can also apply to situations where the human operator is directing some pilot pressure to the first pilot chamber 214*a*, but the controller 302 determines that the pilot pressure is inadequate.

The controller 302 sends a command to the first on/off valve 230*a* commanding the same to the "on" position. The first EHPRV 224*a* is commanded to generate pilot pressure in the first pilot pressure control line 216*a* by communicating pressure from the pilot pressure supply line 208 to the first pilot pressure control line 216*a* through the first EHPRV 224*a* and the first pilot pressure bypass line 222*a*.

The controller 302 may further command the first bidirectional proportional variable orifice valve 220*a* to create a flow path restriction in the first pilot pressure supply line 216*a*. The controller 302 may optionally command the first bidirectional proportional variable orifice valve 220*a* to close the first pilot pressure supply line 216*a*.

Throughout the pressure generation operation, the controller 302 monitors the pilot pressure via the first pressure sensor 232*a*.

Alternative Embodiment of FIGS. 8-11

FIGS. 8-11 illustrate an alternative embodiment of a pilot hydraulic system 400 having a modified hydraulic subsystem 402 wherein the on/off valves 230*a*, 230*b* of the first embodiment have been replaced by mechanical selector valves 404*a*, 404*b*.

Most of the components of the pilot hydraulic system 400 are identical to those of the pilot hydraulic system 200 and the same element numbers have been maintained in FIGS. 8-11. Those substantially identical components will not be described further, and it will be understood that their construction and operation is as previously described. Also, the controller 300 of FIG. 4 may be used to control the pilot hydraulic system 400, the only difference being that there will be no on/off valves 230*a*, 230*b*.

The mechanical selector valves 404*a*, 404*b* operate in response to pressure in their respective pilot pressure supply lines 216*a*, 216*b* which moves the respective valve spool 408*a*, 408*b* against a return spring 406*a*, 406*b*.

Figure 9:
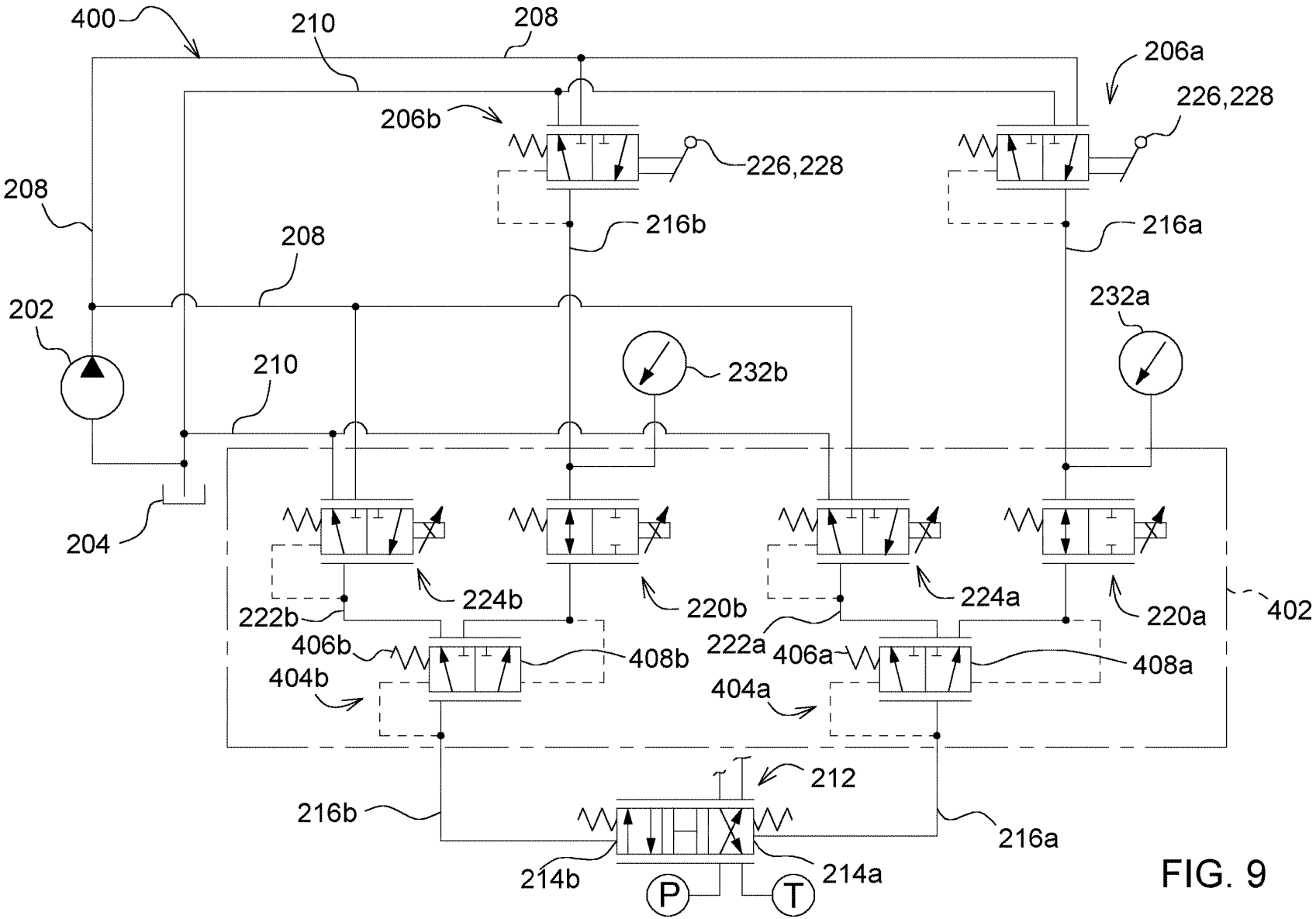
FIG. 9 is a schematic illustration of the pilot hydraulic system of FIG. 8 during normal operation.

FIG. 9 schematically illustrates the normal operation mode of pilot hydraulic system 400 analogous to that of FIG. 5 discussed above. In the normal operation mode of pilot hydraulic system 400 the pilot pressure from the first pilot valve 206*a* operated by operator joystick 228 is passed through the first variable orifice valve 220*a* to the first mechanical selector valve 404*a*. The pressure acts on the side of the mechanical selector valve spool 408*a* of the first mechanical selector valve 404*a* to shift the spool and allow pressure to flow to the first pilot chamber 214*a* of the main control valve 212. Depending upon the size of the return spring 406*a*, the first mechanical selector valve 404*a* will allow some of the pressure to drain through the first bypass line 222*a* and the first EHPRV 224*a* to the pilot pressure return line 210 such that there will be a small constant flow of hydraulic fluid back to the pilot pressure return line 210.

Figure 10:
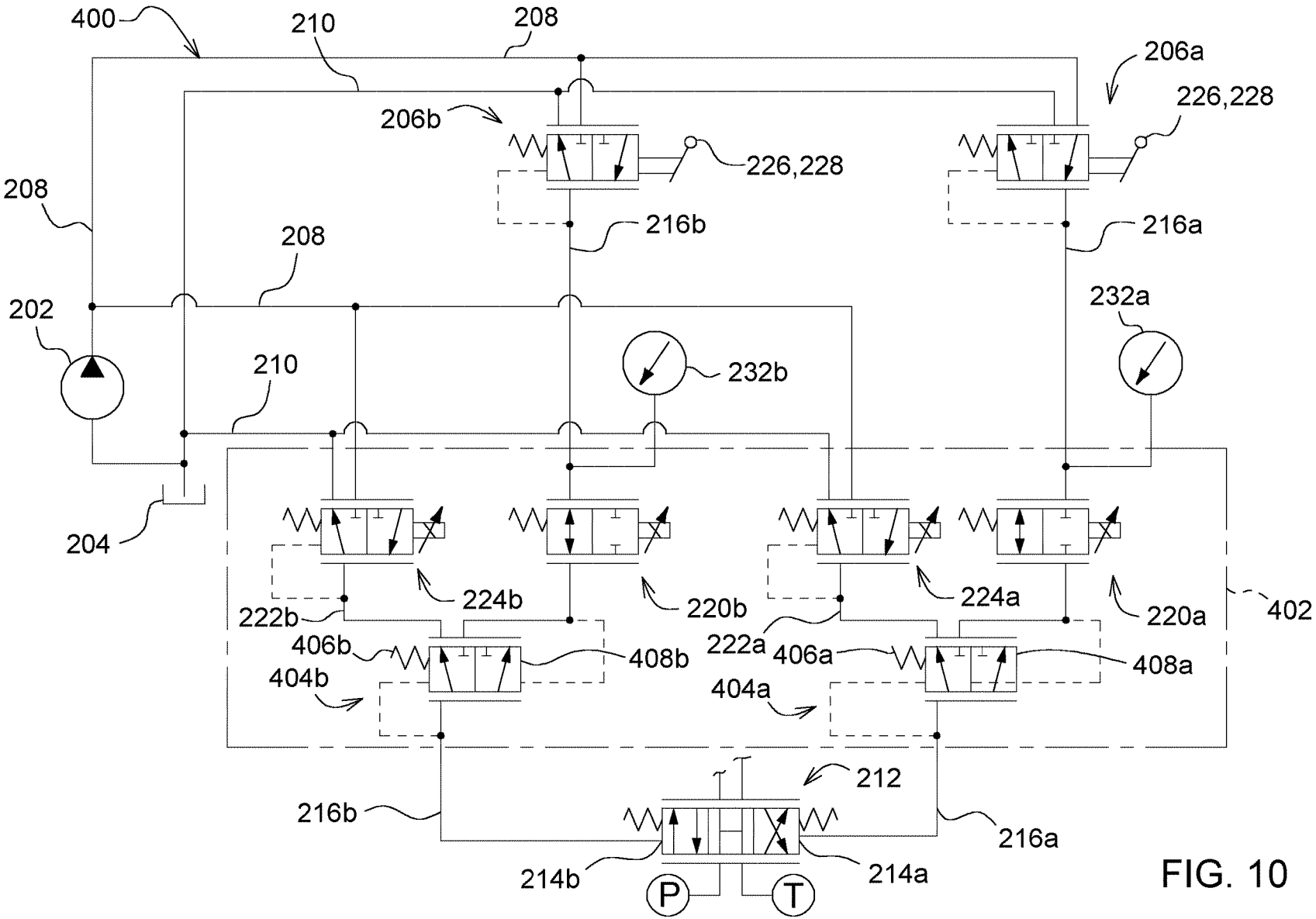
FIG. 10 is a schematic illustration of the pilot hydraulic system of FIG. 8 in a pilot pressure reduction mode.

FIG. 10 schematically illustrates the pressure reduction mode of pilot hydraulic system 400 analogous to that of FIG. 6 discussed above. In the pressure reduction mode of pilot hydraulic system 400 the first EHPRV 224*a* controls the pressure reaching the first pilot chamber 214*a* of the main control valve 212 by draining pressure from the first pilot pressure supply line 216*a* through the first bypass line 222*a* in a manner like that described above regarding FIG. 6. The first variable orifice valve 220*a* may create a restriction to prevent saturation of the first EHPRV 224*a* as described above. The first mechanical selector valve 404*a* allows pressure from the first variable orifice valve 220*a*, as modified by the action of the first EHPRV 224*a*, to reach the first pilot chamber 214*a*.

Figure 11:
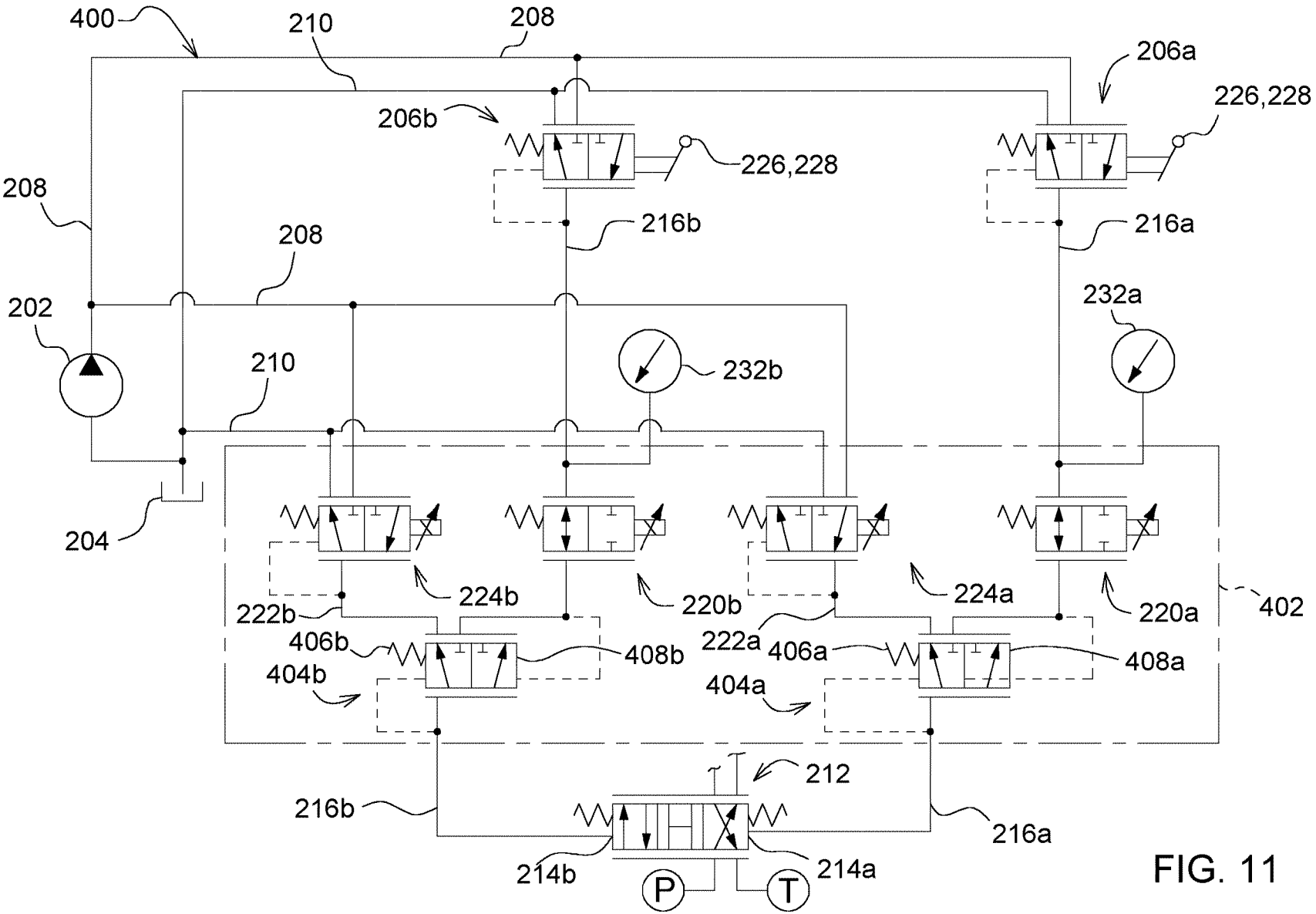
FIG. 11 is a schematic illustration of the pilot hydraulic system of FIG. 8 in a pilot pressure generation mode.

FIG. 11 schematically illustrates the pressure generation mode of pilot hydraulic system 400 analogous to that of FIG. 7 discussed above. The joystick 228 and the first pilot valve 206*a* are again schematically indicated such that the human operator is not directing pilot pressure to the first pilot chamber 214*a*. This mode can also apply to situations where the human operator is directing some pilot pressure to the first pilot chamber 214*a*, but the controller 302 determines that the pilot pressure is inadequate.

The controller 302 sends a command to the first EHPRV 224*a* to generate pilot pressure in the first pilot pressure control line 216*a* by communicating pressure from the pilot pressure supply line 208 to the first pilot pressure control line 216*a* through the first EHPRV 224*a* and the first pilot pressure bypass line 222*a*. The first mechanical selector valve 404*a* allows this communication from the first pilot pressure bypass line 222*a* to the first pilot pressure control line 216*a*.

The controller 302 may further command the first bidirectional proportional variable orifice valve 220*a* to create a flow path restriction in the first pilot pressure supply line 216*a*. The controller 302 may optionally command the first bidirectional proportional variable orifice valve 220*a* to close the first pilot pressure supply line 216*a*. Throughout the pressure generation operation, the controller 302 monitors the pilot pressure via the first pressure sensor 232*a*.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims Each disclosed feature or embodiment may be combined with any of the other disclosed features or embodiments.

What is claimed is:

1. A pilot hydraulic system, comprising:

a pilot pressure source;

a pilot pressure return tank;

a pilot valve;

a manually operable pilot valve control input configured to move the pilot valve when the control input is moved by an operator;

a pilot pressure supply line connecting the pilot pressure source to the pilot valve;

a pilot pressure return line connecting the pilot pressure return tank to the pilot valve;

a main control valve including a pilot chamber;

a pilot pressure control line connecting the pilot valve to the pilot chamber; and a hydraulic sub-system for modifying pilot pressure provided to the pilot chamber of the main control valve, the hydraulic sub-system including:

a variable orifice valve disposed in the pilot pressure control line;

a pilot pressure bypass line communicating the pilot pressure control line downstream of the variable orifice valve with the pilot pressure return line; and an electrohydraulic pressure reducing valve (EHPRV) disposed in the pilot pressure bypass line.

2. The pilot hydraulic system of claim 1, wherein:

the pilot valve is a first pilot valve; and the manually operable pilot valve control input includes an input handle and at least the first pilot valve and a second pilot valve, the handle being configured to move the first pilot valve when the handle is moved in a first direction and to move the second pilot valve when the handle is moved in a second direction.

3. The pilot hydraulic system of claim 2, wherein:

the handle is a joystick.

4. The pilot hydraulic system of claim 1, wherein:

the hydraulic sub-system further includes an on/off valve disposed in the pilot pressure bypass line between the EHPRV and the pilot pressure control line.

5. The pilot hydraulic system of claim 1, wherein:

the hydraulic sub-system further includes a selector valve disposed in the pilot pressure control line and communicated with the pilot pressure bypass line, the selector valve being configured to allow flow from the pilot pressure control line to the pilot pressure bypass line, and to allow flow from the pilot pressure bypass line through the pilot pressure supply line to the pilot chamber.

6. The pilot hydraulic system of claim 1, wherein:

the hydraulic sub-system further includes a pressure sensor communicated with the pilot pressure control line between the pilot valve and the variable orifice valve.

7. The pilot hydraulic system of claim 1, wherein:

the variable orifice valve is a bidirectional proportional variable orifice valve.

8. A pilot hydraulic system, comprising:

a pilot pressure source;

a pilot pressure return tank;

a pilot valve;

a pilot pressure supply line connecting the pilot pressure source to the pilot valve;

a pilot pressure return line connecting the pilot pressure return tank to the pilot valve;

a main control valve including a pilot chamber;

a pilot pressure control line connecting the pilot valve to the pilot chamber; and a hydraulic sub-system for modifying pilot pressure provided to the pilot chamber of the main control valve, the hydraulic sub-system including:

a variable orifice valve disposed in the pilot pressure control line;

a pilot pressure bypass line communicating the pilot pressure control line downstream of the variable orifice valve with the pilot pressure return line; and an electrohydraulic pressure reducing valve (EHPRV) disposed in the pilot pressure bypass line;

wherein the hydraulic sub-system further includes a pressure sensor communicated with the pilot pressure control line;

wherein the pilot hydraulic system further includes a controller connected to the pressure sensor for monitoring pressure in the pilot pressure control line, and connected to the EHPRV and the variable orifice valve for sending control signals to the valves, the controller being configured to have a pilot pressure generation mode wherein the EHPRV is commanded to generate pilot pressure in the pilot pressure control line by communicating pressure from the pilot pressure supply line to the pilot pressure control line through the EHPRV and the pilot pressure bypass line.

9. The pilot hydraulic system of claim 8, wherein:

the controller is further configured in the pilot pressure generation mode to command the variable orifice valve to create a flow path restriction in the pilot pressure supply line.

10. The pilot hydraulic system of claim 8, wherein:

the controller is further configured to have a pilot pressure reduction mode wherein the EHPRV is commanded to regulate pressure delivered from the pilot valve to the pilot chamber by bleeding off pressure from the pilot pressure control line.

11. The pilot hydraulic system of claim 10, wherein:

the controller is further configured in the pilot pressure reduction mode such that the variable orifice valve is commanded to create a flow path restriction in the pilot pressure supply line such that the EHPRV can control the pilot pressure without becoming saturated.

12. The pilot hydraulic system of claim 10, wherein:

the pilot valve is a first pilot valve;

the pilot hydraulic system further includes a manually operable pilot valve control input, including an input handle and at least the first pilot valve and a second pilot valve, the handle being configured to move the first pilot valve when the handle is moved in a first direction and to move the second pilot valve when the handle is moved in a second direction; and the controller is further configured such that when the controller is in either the pilot pressure generation mode or the pilot pressure reduction mode for the first pilot chamber a second pilot chamber of the main control valve is communicated with the pilot pressure return line.

13. The pilot hydraulic system of claim 10, wherein:

the controller is further configured to have a normal operation mode in which pilot pressure from the pilot valve is passed through the hydraulic sub-system to the pilot chamber unmodified; and the hydraulic sub-system further includes an on/off valve disposed in the pilot pressure bypass line between the EHPRV and the pilot pressure control line, the on/off valve being closed in the normal operation mode, and the on/off valve being open in the pilot pressure generation mode and in the pilot pressure reduction mode.

14. The pilot hydraulic system of claim 10, wherein:

the controller is further configured to have a normal operation mode in which pilot pressure from the pilot valve is passed through the hydraulic sub-system to the pilot chamber; and the hydraulic sub-system further includes a mechanical selector valve disposed in the pilot pressure control line and communicated with the pilot pressure bypass line, the mechanical selector valve being configured:

to communicate pressure from the pilot valve to the pilot chamber in the normal operation mode;

to allow flow from the pilot pressure control line to the pilot pressure bypass line in the pilot pressure reduction mode; and to allow flow from the pilot pressure bypass line through the pilot pressure supply line to the pilot chamber in the pilot pressure generation mode.

15. The pilot hydraulic system of claim 1, wherein:

the hydraulic sub-system further includes a pressure sensor communicated with the pilot pressure control line; and the pilot hydraulic system further includes a controller connected to the pressure sensor for monitoring pressure in the pilot pressure control line, and connected to the EHPRV and the variable orifice valve for sending control signals to the valves, the controller being configured to have a pilot pressure reduction mode wherein:

the variable orifice valve is commanded to create a flow path restriction in the pilot pressure supply line; and the EHPRV is commanded to regulate pressure delivered from the pilot valve to the pilot chamber by bleeding off pressure from the pilot pressure control line.

* * * * *